US008952326B1

(12) United States Patent
Ugarov

(10) Patent No.: US 8,952,326 B1
(45) Date of Patent: Feb. 10, 2015

(54) ATMOSPHERIC PRESSURE INTERFACE WITH IMPROVED ION TRANSFER FOR SPECTROMETRY, AND RELATED SYSTEMS AND METHODS

(71) Applicant: Agilent Technologies, Inc., Loveland, CO (US)

(72) Inventor: Michael Ugarov, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/071,457

(22) Filed: Nov. 4, 2013

(51) Int. Cl.
*H01J 49/00* (2006.01)
*H01J 49/04* (2006.01)

(52) U.S. Cl.
CPC ..... *H01J 49/0495* (2013.01); *H01J 49/0422* (2013.01)
USPC ..... 250/288; 250/281; 250/282; 250/283; 250/289; 250/293; 250/297

(58) Field of Classification Search
USPC ..... 250/281–283, 288, 289, 293, 297
See application file for complete search history.

(56) References Cited

U.S. PATENT DOCUMENTS

| | | | | |
|---|---|---|---|---|
| 5,658,413 | A | 8/1997 | Kaltenbach et al. | |
| 7,534,997 | B2 * | 5/2009 | Li | 250/288 |
| 8,148,679 | B2 | 4/2012 | Makarov et al. | |
| 2007/0221839 | A1 | 9/2007 | Goodley et al. | |
| 2011/0266432 | A1 * | 11/2011 | Ugarov | 250/282 |
| 2012/0318973 | A1 * | 12/2012 | Loucks et al. | 250/288 |

OTHER PUBLICATIONS

Guevremont, et al.; High Field Assymetric Waveform Ion Mobility Spectrometry-Mass Spectrometry: an Investigation of Leucine Enkephalin Ions Produced by Electrospray Ionization; American Society for Mass Spectrometry; 1999, 10, 492-501.

* cited by examiner

*Primary Examiner* — Jack Berman
*Assistant Examiner* — Meenakshi Sahu

(57) ABSTRACT

An atmospheric pressure (AP) interface for a spectrometer includes wall for separating an ionization chamber from a reduced-pressure region of the spectrometer, an ion inlet defining an ion path from the ionization chamber to the reduced-pressure region, and a passage defining a gas path from the ionization chamber to a gas outlet external to the reduced-pressure region. The passage may have a greater gas conductance than the ion inlet such that most gas into the passage and not the ion inlet. The interface device is configured for applying a static electric field effective for focusing ions in the ionization chamber preferentially into the ion inlet.

20 Claims, 6 Drawing Sheets

ATMOSPHERIC PRESSURE INTERFACE WITH IMPROVED ION TRANSFER FOR SPECTROMETRY, AND RELATED SYSTEMS AND METHODS

TECHNICAL FIELD

The present invention relates generally to spectrometry, such as mass spectrometry and ion mobility spectrometry, performed in conjunction with ionization carried out at or near atmospheric pressure. The invention specifically relates interfacing an atmospheric pressure ionization apparatus with a spectrometer.

BACKGROUND

A spectrometry system in general includes an ionization apparatus (or ion source) for ionizing components of a sample of interest, an analyzer for separating the ions based on a discriminating attribute, an ion detector for counting the separated ions, and electronics for processing output signals from the ion detector as needed to produce user-interpretable spectral information. The spectral information may be utilized to determine the molecular structures of components of the sample, thereby enabling the sample to be qualitatively and quantitatively characterized. In a mass spectrometry (MS) system, the analyzer is a mass analyzer that separates the ions based on their differing mass-to-charge ratios (or m/z ratios, or more simply "masses"). Depending on design, the mass analyzer may separate ions by utilizing electric and/or magnetic fields, or time-of-flight tubes. The mass analyzer is limited to operation at very low vacuum. In an ion mobility spectrometry (IMS) system, the analyzer is a drift cell that separates ions based on their different collision cross-sections. Ions are pulled through the drift cell by a DC voltage gradient in the presence of a drift gas. Ions of differing cross-sectional areas have differing mobilities through the gas environment. The drift cell may be configured for operation at vacuum or at atmospheric pressure. An IMS may be coupled with an MS to provide unique two-dimensional information about an analyte under investigation. Additionally, in certain "hyphenated" or "hybrid" systems the sample supplied to the ionization apparatus may first be subjected to a form of analytical separation. For example, in a liquid chromatography-mass spectrometry (LC-MS) system or a gas chromatography-mass spectrometry (GC-MS) system, the output of the LC or GC column may be transferred into the ionization apparatus through appropriate interface hardware.

Various types of ionization apparatuses may be utilized in conjunction with spectrometry. Some ionization apparatuses operate at vacuum levels while others operate at atmospheric pressure (AP). Each type of ionization technique has its advantages and disadvantages. For example, AP ionization is compatible with the high-throughput provided by LC instruments. Examples of AP ionization include, but are not limited to, electrospray ionization (ESI), atmospheric pressure chemical ionization (APCI) atmospheric pressure photo-ionization (APPI), or atmospheric-pressure laser ionization (APLI).

An AP interface is required to successfully couple an AP ionization apparatus to a spectrometer operating at vacuum such as an MS or a reduced-pressure IMS. One of the main areas of inefficiency of spectrometric analysis has to do with collecting ions from the AP ionization apparatus and transferring them into the lower pressure stages of the analyzer. The difficulty stems from the fact that ion motion in an AP interface is controlled by both electrostatic fields and, even more strongly, by the gas dynamics. Any attempts to focus ions into an ion transfer component such as an orifice or capillary through the use of electrostatic fields are hampered by the gas dynamics.

An existing approach to addressing this problem entails increasing the gas throughput of the AP interface so that more gas is admitted into the first differentially pumped stage of the spectrometer. This approach can increase the amount of ions captured as well. A disadvantage of this approach is that the separation of ions from the gas now must occur at a relative high pressure. Devices have been developed to provide such separation such as electrodynamic ion funnels. Such devices work reasonably well up to a certain pressure level but have their own disadvantages, including the addition of cost and complexity to the system. For example, additional pumps are usually needed to evacuate the gas. Moreover the gas dynamics at elevated pressures (such as 10 to 30 Torr) make focusing low mobility ions a challenge.

Therefore, there is an ongoing need for improvements in interfacing an atmospheric pressure ionization apparatus with a spectrometer.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an atmospheric pressure (AP) interface for a spectrometer includes: an ionization chamber comprising a wall for separating the ionization chamber from a reduced-pressure region of the spectrometer; and an interface device comprising an ion inlet and a gas passage, wherein: the ion inlet defines an ion path from the ionization chamber to the reduced-pressure region; the gas passage defines a gas path from the ionization chamber to a gas outlet external to the reduced-pressure region; the gas passage has a greater gas conductance than the ion inlet such that most gas flowing into the interface device flows into the gas passage and not the ion inlet; and the interface device is configured for applying a static electric field effective for focusing ions in the ionization chamber preferentially into the ion inlet.

According to another embodiment, an atmospheric pressure (AP) interface for a spectrometer includes: an ionization chamber comprising a wall for separating the ionization chamber from a reduced-pressure region of the spectrometer; an electrically conductive inner conduit extending along an axis through the wall from the ionization chamber to the reduced-pressure region; an electrically conductive outer conduit extending through the wall and surrounding the inner conduit to define a passage therebetween, wherein the passage is outside the reduced-pressure region and terminates at a gas outlet; and a voltage source communicating with the inner conduit and the outer conduit and configured for generating a static electric field having a spatial orientation that attracts ions toward the axis, wherein the inner conduit defines an ion path from the ionization chamber to the reduced-pressure region, and the passage defines a gas path from the ionization chamber to the gas outlet and external to the reduced-pressure region.

According to another embodiment, an analytical separation system includes: an AP interface according to any embodiment disclosed herein; and a spectrometer, wherein the spectrometer comprises a reduced-pressure region and an analytical separation instrument in or communicating with a reduced-pressure region.

According to another embodiment, an analytical separation system includes: an atmospheric pressure ion source; and an atmospheric pressure ion mobility spectrometer (IMS) drift cell comprising a cell inlet communicating with the ion source and an atmospheric pressure (AP) interface downstream from the cell inlet, the AP interface comprising an ion inlet defining an ion path from the drift cell to a reduced-pressure region, and gas passage defining a gas path from the drift cell to a location external to the reduced-pressure region.

According to another embodiment, a method for transferring ions to a spectrometer includes: operating an ionization chamber containing ions and gas at about atmospheric pressure or greater, the ionization chamber communicating with reduced-pressure region of the spectrometer via an ion inlet; directing the gas in the ionization chamber through a passage to a gas outlet outside the reduced-pressure region, wherein the gas flows according to a pressure differential between the ionization chamber and the gas outlet; and directing the ions through the ion inlet and into the reduced-pressure region, wherein the gas flows preferentially into the passage and the ions flow preferentially into the inner conduit.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

In the context of the present disclosure, the term "atmospheric pressure" is not limited to an exact value for atmospheric pressure such as 1 atmosphere (760 Torr) at sea level. Instead, the term "atmospheric pressure" also generally encompasses any pressure that is substantially at (i.e., about, approximately, or near) atmospheric pressure. Accordingly, "atmospheric pressure" generally encompasses a range of pressures from about 720 Torr to about 800 Torr.

Figure 1:
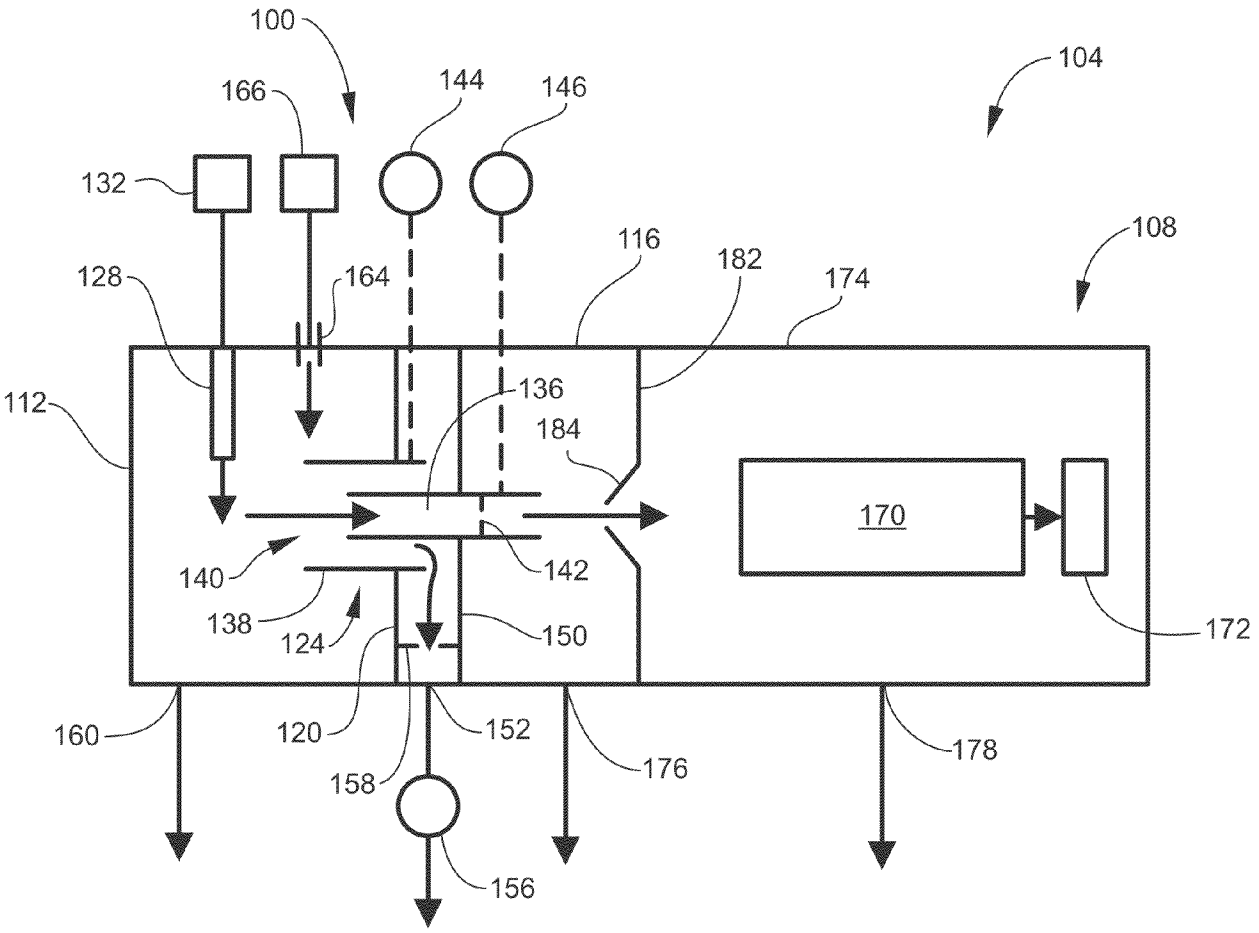
FIG. 1 is a schematic view of an example of an atmospheric pressure (AP) interface according to some embodiments.

FIG. 1 is a schematic view of an example of an atmospheric pressure (AP) interface 100 according to some embodiments. Generally, the AP interface 100 is configured for efficiently transporting ions from a region at (or above) atmospheric pressure to a region at sub-atmospheric pressure. The AP interface 100 may also be configured for removing gas from the atmospheric-pressure region in a manner that improves the efficiency of ion transport to the sub-atmospheric region and facilitates the separation of gas from ions in the sub-atmospheric region. The sub-atmospheric pressure may be a vacuum pressure, for example in a range from 30 Torr or less, or from 1 to 30 Torr, or in another example in a range from 20 Torr or less, or from 1 to 20 Torr. As a non-limiting example, FIG. 1 illustrates an analytical separation system 104 in which the AP interface 100 is operatively integrated with a spectrometer 108. Accordingly, in this embodiment the region at (or above) atmospheric pressure is an ionization chamber 112 and the region at sub-atmospheric pressure is a reduced-pressure chamber 116 of the spectrometer 108 (e.g., the first vacuum stage). The AP interface 100 includes at least one wall 120 that provides a structural boundary between the ionization chamber 112 and the reduced-pressure chamber 116. The AP interface 100 includes an interface device 124 that establishes an ion path from the ionization chamber 112 to the reduced-pressure chamber 116, and a separate gas path from the ionization chamber 112 to outside the analytical separation system 104, as described in further detail below.

The ionization chamber 112 is part of an AP ion source that includes an ionization device 128. The ion source 128 may be configured for any type of AP ionization such as, for example, electrospray ionization (ESI), atmospheric pressure chemical ionization (APCI) atmospheric pressure photo-ionization (APPI), or atmospheric-pressure laser ionization (APLI). A sample source 132 provides a stream of sample material to the ionization chamber 112. In some embodiments, the sample source 132 may be an analytical separation device such as, for example, the column of a liquid chromatograph (LC). Depending on the type of ionization device 128 provided, the sample source 132 may provide sample material to the ionization device 128, from which ionized or partially ionized sample material is emitted into the ionization chamber 112, or the sample source 132 may provide sample material to the ionization chamber 112 via a separate sample inlet (not shown) for interaction with the energy output from the ionization device 128 in an ionization region in front of the interface device 124. In some embodiments, the sample source 132 may be associated with a microfluidic or nanofluidic chip such as disclosed, for example, in U.S. Patent App. Pub. No. 2007/0221839 or U.S. Pat. No. 5,658,413, the entire contents of which are incorporated by reference herein. The chip may be configured to emit a low-flow electrospray or nano-electrospray ("nanospray").

The interface device 124 is configured for establishing (defining) an ion path from the ionization chamber 112 to the reduced-pressure chamber 116, and a gas path from the ionization chamber 112 to a gas outlet external to the reduced-pressure chamber 116. In some embodiments, the interface device 124 includes an electrically conductive inner conduit (inner electrode) 136 and an electrically conductive outer conduit (outer electrode) 138, both extending through the wall 120 along an ion sampling (or ion transfer) axis. The conduits 136 and 138 may be generally tube-shaped with circular or polygonal cross-sections. In some embodiments, the conduits 136 and 138 are positioned along a common axis, and the outer conduit 138 surrounds at least a portion of the inner conduit 136. By this configuration, a gas discharge passage 140 through the wall 120 is defined between the inner conduit 136 and the outer conduit 138. The gas discharge passage 140 may have a contiguous opening surrounding the inner conduit 136, or a number of ports surrounding the inner conduit 136. In other embodiments, the inner conduit 136 and/or the outer conduit 138 may not have a significant axial length and instead be configured more like an orifice.

As described in further detail below, in operation an electrostatic field is applied between the inner conduit 136 and the outer conduit 138. FIG. 1 schematically depicts voltage sources 144 and 146 in signal communication with the inner conduit 136 and the outer conduit 138, respectively, for applying a DC voltage between the inner conduit 136 and the outer conduit 138. In operation, the inner conduit serves as the ion inlet into the spectrometer 108 and the gas discharge passage 140 serves as an outlet from which a substantial amount of gas may be removed from the ionization chamber 112 without entering the spectrometer 108. As described in further detail below, the inner conduit 136 and outer conduit 138 are structured and operated such that a maximum amount of ions and a minimum amount of gas enter the inner conduit 136, and a maximum amount of gas and a minimum amount of ions enter the outer conduit 138.

The inner conduit 136 includes an inlet located in the ionization chamber 112 and an outlet outside the ionization chamber 112. In FIG. 1, the outlet of the inner conduit 136 is shown located in the reduced-pressure chamber 116. More generally, the inner conduit 136 defines at least a part of the ion path that leads into the reduced-pressure chamber 116. In practice, the inner conduit 136 may communicate with other structures that complete the ion path into the reduced-pressure chamber 116. For example, in some embodiments a gas conductance limiting device 142, such as one or more flow restrictors (e.g., frits, orifice plates, capillaries, etc.), may be located in the ion path between the inlet of the inner conduit 136 and the reduced-pressure chamber 116 to control gas flow and pressure.

The outer conduit 138 includes an inlet located in the ionization chamber 112 and an outlet external to the reduced-pressure chamber 116. In some embodiments, a structure of the analytical separation system 104 may enclose an internal region 150 with which the outlet communicates. The internal region 150 extends the gas path to another outlet 152. This structure and its internal region 150 may be considered as being a part of the AP interface 100 or the spectrometer 108. Either of the outlets communicating with the gas discharge passage 140 may be considered as being the gas outlet leading out from the ionization chamber 112. In either case, the gas outlet(s), and the gas path running from the ionization chamber 112 to the gas outlet(s), are external to the reduced-pressure chamber 116. Consequently, gas removed from the ionization chamber 112 via the gas outlet(s) does not enter the reduced-pressure chamber 116 or any other regions of the spectrometer 108 in which ions are processed. In some embodiments, the outlet is a vent to atmosphere. In some embodiments, the gas discharge passage 140 communicates with a pump 156 and associated plumbing. The pump 156 may be located upstream or downstream of the outlet. In some embodiments, gas conductance limiting device 158, such as one or more flow restrictors (e.g., frits, orifice plates, etc.) may be located in the gas path between the inlet of the outer conduit 138 and the pump 156 to control gas flow conditions. In some embodiments, only a relatively small pressure differential between the ionization chamber 112 and the outlet is needed for adequately driving the gas flow through the gas discharge passage 140. Moreover, the gas removed by way of the gas discharge passage 140 need not be utilized for any purpose, and thus may be considered as waste gas. Further, as the gas path is completely external to ion-occupied regions of the spectrometer 108, the gas removed by way of the gas discharge passage 140 is not a source of contamination. For these reasons, the pump 156 may be a relatively inexpensive pump.

In other embodiments, a pump 156 may not be utilized in the gas path. Instead, the pressure differential between the ionization chamber 112 and the outlet may be created by "over-pressurizing" the ionization chamber 112, i.e., pressurizing to a level above atmospheric pressure, while the outlet is around the atmospheric pressure of the ambient. The ionization chamber 112 may be over-pressurized, for example, by increasing the flow of sample spray and/or introducing a drying gas (described below).

In still other embodiments, an existing differential pump provided with the spectrometer 108 may be utilized for driving the gas flow through the gas discharge passage 140. In this case, separate plumbing (gas circuitry) constituting part of the gas path would communicate with the existing differential pump with different flow conditions than the plumbing communicating with the spectrometer region also being served by the existing differential pump.

The ionization chamber 112 further includes an exhaust port 160 communicating with a pump and associated plumbing to provide a flow path for removal of neutral gases, vapors and droplets (e.g., sample matrix material, solvents, etc.) from the ionization chamber 112. As the material removed by way of this exhaust port 160 may be considered as waste material, in some embodiments the exhaust port 160 and the gas discharge passage 140 may communicate with the same pump 156.

In some embodiments, AP interface 100 additionally includes a drying gas inlet 164 through which a stream of drying gas is supplied from a drying gas source 166 into the ionization chamber 112. The drying gas may be heated by any suitable means. The drying gas may be any chemically inert gas suitable for use in AP ionization, a few non-limiting examples being nitrogen ($N_2$), carbon dioxide ($CO_2$) and argon (Ar). In any AP ionization technique, ideally only the analyte ions enter the spectrometer 108, and not the other components of the sample spray such as neutral solvated droplets, or air or oxygen. Such other components contaminate the spectrometer 108, and impair the ion signal from which analytical data is derived and lower the sensitivity of the spectrometer 108. To address this problem, the drying gas may be introduced to assist in the evaporation of solvent and/or sweep the solvent away from the inner conduit 136 leading into the spectrometer 108, as well as to assist in the evaporation and desolvation of ions from the sample spray. The drying gas may be introduced through one or more openings around the outer conduit 138, in counterflow relation to the spray as the spray approaches the interface device 124. Alternatively, the drying gas may be introduced as a "curtain" or "knife" in front of the outer conduit 138.

The spectrometer 108 includes an analytical separation instrument (ion analyzer) 170 and an ion detector 172. The spectrometer 108 may be a mass spectrometer (MS), in which case the analytical separation instrument 170 may include a mass analyzer of any type compatible with AP ionization. Alternatively, the spectrometer 108 may be an ion mobility spectrometer (IMS), in which case the analytical separation instrument 170 may include a drift tube. Alternatively, the spectrometer 108 may be a hybrid instrument that includes more than one type of analytical separation instrument (for example, an IMS drift tube followed by a mass analyzer). Alternatively or additionally, the spectrometer 108 may be a tandem instrument that performs more than one stage of analytical separation and an intervening stage of ion fragmentation (for example, an ion trap or a triple-quad (QQQ) system). The ion detector 172 may be any device configured for collecting and measuring the flux (or current) of ions outputted from the analytical separation instrument 170. Examples of ion detectors 172 include, but are not limited to, electron multipliers, photomultipliers, Faraday cups, and micro-channel plate (MCP) detectors. The structure and operation of various types of spectrometers and associated components are generally understood by persons skilled in the art, and thus are described only briefly herein as necessary for understanding the presently disclosed subject matter.

In some embodiments, the spectrometer 108 may only need one reduced-pressure chamber, e.g., the reduced-pressure chamber 116. For example, in a case where the analytical separation instrument 170 is an IMS drift cell, the IMS drift cell may be located in the reduced-pressure chamber 116 (not specifically shown). In other embodiments and as shown in FIG. 1, in addition to the first reduced-pressure chamber 116 the spectrometer 108 may include at least a second reduced-pressure chamber 174 that encloses the analytical separation instrument 170. In this case, the analytical separation instrument 170 may be a mass analyzer. In other embodiments in which the analytical separation instrument 170 includes an IMS drift cell followed by a mass analyzer, the IMS drift cell may be located in the reduced-pressure chamber 116 (not specifically shown) and the mass analyzer may be located in the second reduced-pressure chamber 174. The spectrometer 108 may also include one or more intermediate reduced-pressure chambers between the first reduced-pressure chamber 116 and second reduced-pressure chamber 174, as appreciated by persons skilled in the art.

The reduced-pressure chambers 116 and 174 include respective vacuum ports 176 and 178. The spectrometer 108 includes a vacuum system communicating with vacuum ports as schematically depicted by arrows, representing one or more vacuum-generating pumps and associated plumbing and other components appreciated by persons skilled in the art. The vacuum system maintains the reduced-pressure chambers 116 and 174 at controlled, successively reduced pressure levels (in FIG. 1, from left to right). The internal pressure of the first reduced-pressure chamber 116 may generally range, as one non-limiting example, in a range from 30 Torr or less, or from 1 to 30 Torr, or in another example from 20 Torr or less, or from 1 to 20 Torr, depending on the pressure differential needed between the ionization chamber 112 and the first reduced-pressure chamber 116. The internal pressure of the second reduced-pressure chamber 174 may generally range, as one non-limiting example, from 0.01 to 1 Torr, depending on the type of analytical separation instrument 170 employed. The vacuum system may also remove any residual non-analytical components such as neutral molecules from the spectrometer 108. Adjacent reduced-pressure chambers are separated by a wall 182 providing an ion outlet 184 for transferring analyte ions from one chamber to the next. The ion outlet 184 may be any component or combination of components configured for enabling the ions to be transferred with minimal or no loss of ions, with minimal transfer of non-analytical components, and without breaking vacuum. The ion outlet 184 may, for example, include one or more of the following, as appreciated by persons skilled in the art: capillary, orifice, ion optics, skimmer plate, ion guide, ion funnel, aperture, etc.

Figure 2:
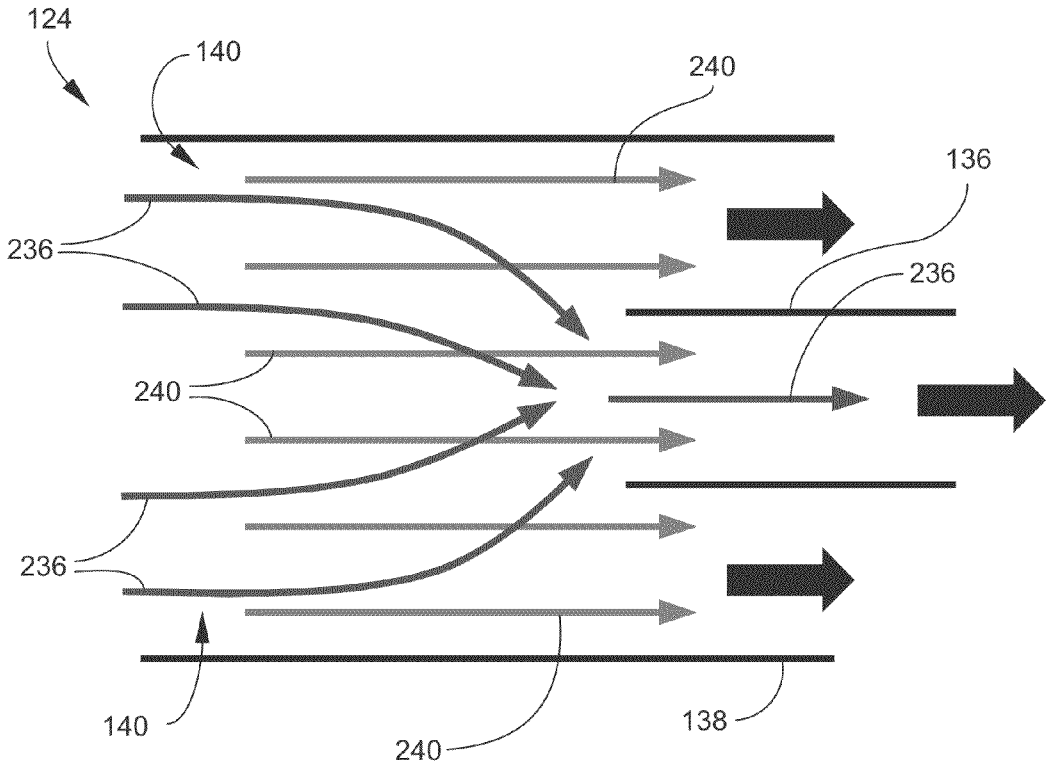
FIG. 2 is a schematic view of an interface device of an AP interface according to some embodiments.

FIG. 2 is a schematic view of the interface device 124 illustrating the ion path and gas path established by its structure and operation. Ions are preferentially attracted to the inner conduit 136 by the electrostatic field, as depicted by ion trajectories 236. The neutral gas particles, however, are unaffected by the electrostatic field. The gas flow thus proceeds undisturbed into both the inner conduit 136 as well as the gas discharge passage 140, as depicted by gas flow lines 240. The geometry of the interface device 124, the position and geometry of any flow restrictors provided in the gas path, and the speed of the pump (if provided), may be configured such that the gas flow is as uniform and steady as possible, and laminar or close to laminar (i.e., in the transition regime between turbulent and laminar flow), inside the outer conduit 138. In this way, the gas motion would act similarly on all ions and assist in their collection into the inner conduit 136. The small inner conduit 136 and any conductance limiting device 142 provided serve as a gas conductance barrier, and the cross-sectional flow area of the inner conduit 136 is small compared to the cross-sectional flow area of the gas discharge passage 140. Consequently, most of the gas flows into the gas discharge passage 140 instead of the inner conduit 136. In other words, unlike conventional interfaces, only a relatively small portion of the gas admitted into the ionization chamber is subsequently allowed to enter the spectrometer. The rest of the gas is purged from the system via the gas outlet downstream of the gas discharge passage 140. Less gas flow into the first reduced-pressure region of the spectrometer results in lower pressure and easier separation of the collected ions from the gas in this region. For example, the pressure in the first reduced-pressure region may be in the range of Torrs instead of tens of Torrs. In some embodiments, the configuration of the interface device 124 may eliminate the need for advanced interface components such as ion funnels, or enable simplified operation and/or design of such interface components. The configuration of the interface device 124 may enable a broader mass range of ions to be transmitted as well as a more stable ion signal.

In some embodiments, the outer conduit 138 may have a diameter in a range of, for example, about 2 to 10 times greater than the diameter of the inner conduit 136, or as another example about 3 to 5 times greater than the diameter of the inner conduit 136. In the present context, for convenience the term "diameter" encompasses a dimension characteristic of the size of the cross-sectional flow area of the inner conduit 136 or outer conduit 138—for example, diameter in the case of a circular cross-section, or length of the largest side in the case of a polygonal cross-section. In some embodiments, the interface device 124 is structured such that, for example, about 3 or greater times more gas (number of gas particles), or in another example 3 to 15 times more gas, flows into the gas discharge passage 140 than into the inner conduit 136. As one example, if the ratio of inner conduit diameter to outer conduit diameter is about 1:3, then the ratio of gas entering the inner conduit 136 to gas entering the gas discharge passage 140 may be only about 1:10.

It will be noted that the pumping requirements for driving gas flow through the gas discharge passage 140 are much simpler as compared to the typical requirements for the pumps that evacuate gas from the ion path. This reduces the possibility of contamination of internal components of the spectrometer. Additionally, the gas conductance through the gas discharge passage 140 may be high enough that only a small pressure differential is needed to provide the required gas flow through the gas discharge passage 140. Moreover, as described above, the need for a pump in the gas path downstream of the gas discharge passage 140 may be eliminated by over-pressurizing the ionization chamber such that the gas path leads to gas outlet(s) functioning merely as vent(s) for the gas escaping from the system, thereby simplifying the design.

Figure 3:
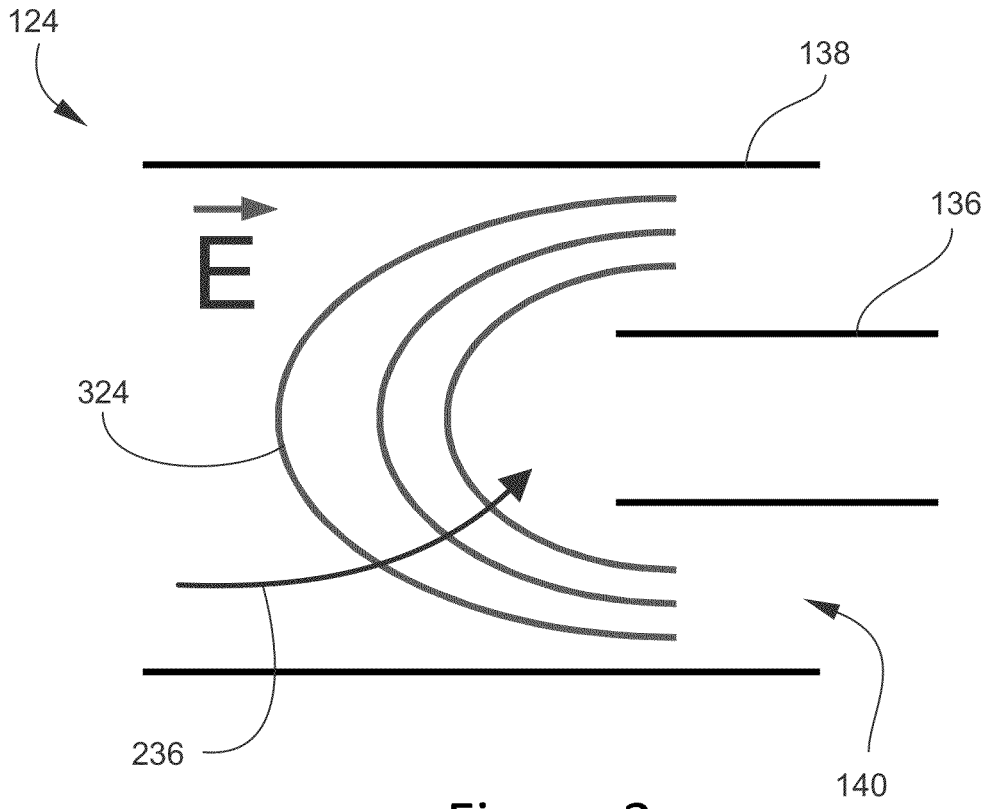
FIG. 3 is a schematic view of the interface device illustrating an example of the static electric field established by its structure and operation.

FIG. 3 is a schematic view of the interface device 124 illustrating an example of the static electric field established by its structure and operation, as depicted by a distribution of electric field lines 324. In the illustrated embodiment, the inner conduit 136 and outer conduit 138 are concentric cylinders. Also, the inlet of the inner conduit 136 is axially offset from the inlet of the outer conduit 138, such that the inner conduit 136 is recessed in the interior of the outer conduit 138. This geometry results in the electric field having a spatial orientation effective for focusing ions toward the ion sampling axis and into the inner conduit 136, as illustrated by one example of an ion trajectory. The focusing of ions in this case may be accomplished purely by means of electrostatic field action. The voltage (potential difference) applied between the inner conduit 136 and the outer conduit 138 may be in a range, for example, from 100 V to 2000 V. As an example, a voltage of about 500 V would typically be necessary for an inter-electrode distance of about 2 mm. This field would cause a corresponding 5 mm drift of a typically m/z=800 ion in about 1 ms. This time would normally be shorter than the time it takes gas to travel through the interior of the interface device 124 and into the inner conduit 136. Therefore, the ions would have sufficient time to reach the inner conduit 136 without their trajectories being adversely affected by the gas flow. In the present embodiment, the axial offset between the respective inlets of the inner conduit 136 and the outer conduit 138 may be set long enough to afford ions the time needed to refocus their trajectories toward the ion sampling axis as illustrated.

It will be noted that ions and particles with different mobility values respond differently to the electric field. Embodiments of the interface device 124 may be configured to take of advantage of this fact by facilitating reducing the penetration of small droplets and non-fully desolvated ions into the inner conduit 136. Specifically, larger particles and solvated ions will experience significantly lower deflection in the electric field 324 and are more likely to follow the gas into the gas discharge passage 140, thereby helping to reduce contamination of internal components of the spectrometer and reducing signal-to-noise (S/N) ratios.

In some embodiments, the AP interface is configured for enabling the gas flow through the inner conduit 136, or the ratio of gas entering the inner conduit 136 to gas entering the gas discharge passage 140, to be adjusted. This adjustment may be done, for example, by adjusting the pumping speed of the pump utilized to evacuate the first reduced-pressure region and/or the pump operating in the gas path downstream of the gas discharge passage 140. The adjustment may also be done by changing the conductances of orifices or tubes associated with the gas paths.

It will be understood that the geometry of the interface device 124 illustrated in FIGS. 1 to 3 is but one example. More generally, the interface device 124 may have any geometry suitable for focusing ions and limiting gas flow into the spectrometer 108 in the manner disclosed herein.

Figure 4:
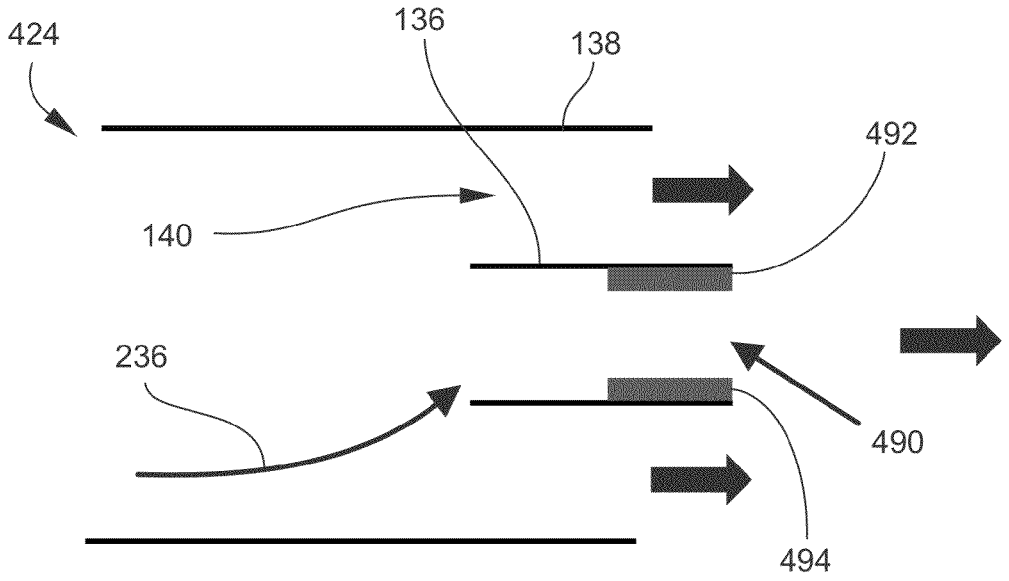
FIG. 4 is a schematic view of an example of an interface device according to another embodiment.

FIG. 4 is a schematic view of an example of an interface device 424 according to another embodiment. A field-asymmetric ion mobility spectrometry (FAIMS) device (or cell) 490 is integrated with the interface device 424. The FAIMS device 490 includes two opposing FAIMS electrodes 492 and 494 positioned in the inner conduit such 136 that the ion sampling axis passes between the FAIMS electrodes 492 and 494. The FAIMS electrodes may be mounted to the inside surface of the inner conduit 136. In some embodiments, the FAIMS electrodes 492 and 494 may be shaped as flat plates. The inner conduit 136 may have a polygonal cross-section in the region where the FAIMS electrodes 492 and 494 are located. A flow-restricting component such as the conductance limiting device 142 schematically illustrated in FIG. 1 may be positioned downstream of the FAIMS device 490 such that the FAIMS device 490 operates at around atmospheric pressure.

Generally, the FAIMS device 490 is related to a conventional IMS device but differs in several respects. In IMS, under a fixed set of conditions ion mobility K may be expressed as the constant of proportionality between an ion's drift velocity $v_D$ and the applied electric field E, as follows: $K=v_D/E$. Ion mobility K is compound-dependent. In a conventional IMS device in which the strength of the applied electric field E is low, ion mobility K is independent of the strength of the electric field E. By contrast, in the FAIMS device 490 the strength of the applied electric field E is high (e.g., 10,000 V/cm), ion mobility K is no longer constant, and the ion drift velocity $v_D$ is no longer directly proportional to the applied electric field E. See Gueveremont and Purves, "High Field Asymmetric Waveform Ion Mobility Spectrometry-Mass Spectrometry: An Investigation of Leucine Enkephalin Ions Produced by Electrospray Ionization," J Am Soc Mass Spectrom 1999, 10, 492-501. Depending on the type of ion (mass, charge, size, and shape), the mobility of one type of ion may increase with increasing electric field strength, while the mobility of another type of ion may decrease increasing electric field strength, while the mobility of yet another type of ion may increase with increasing electric field strength and then decrease with further increasing electric field strength. On the other hand, the mobility values of all three of the foregoing types of ions may be about the same at the low electric field strength ranges applied in conventional IMS. Hence, FAIMS can enhance the selectivity of such ions.

The FAIMS electrodes 492 and 494 are in signal communication with a voltage source (not shown) configured for generating an electric field between the FAIMS electrodes 492 and 494 and thus oriented transversely to the nominal ion optical axis and direction of gas flow. The applied voltage has an asymmetric waveform composed of oscillating periods of a high voltage and a low voltage of opposite polarity. The period of time during which the high voltage is applied is different (typically shorter) than the period of time during which the low voltage is applied. The resulting asymmetric electric field causes ions to drift radially toward one of the FAIMS electrodes 492 and 494 or the other depending on their individual mobility behaviors during application of the high voltage component. A DC compensation voltage may be applied to one of the FAIMS electrodes 492 and 494 to counteract the drift of an ion toward that electrode and thereby prevent the ion from impacting it. The DC compensation voltage may be held at a fixed value for period of time that will allow selected ions to pass through the FAIMS device 490 while all other ions drift to and are lost on the FAIMS electrodes 492 and 494. Alternatively or additionally, the DC compensation voltage may be varied to provide a scanning function whereby ions may be transmitted through the FAIMS device 490 one at a time based on their differing mobility behaviors. Accordingly, with the FAIMS device 490 installed the interface device 424 may be utilized as an ion focusing device, or as both an ion focusing device and an ion filter.

As described above, gas flow through the inner conduit 136 is adjustable. This adjustability may be useful when the FAIMS device 490 is integrated into the inner conduit 136. The performance of FAIMS depends on the gas flow through the FAIMS device 490, as the ions spend more or less time in the separation region depending on whether the gas velocity is lower or higher, respectively. By directing part (or most) of the gas flow away from the inner conduit 136 and instead into the gas discharge passage 140, while concentrating ions in the inner conduit 136 and consequently in the FAIMS device 490, the gas flow velocity in the FAIMS device 490 may be maintained at an appropriate low value to achieve a desired degree of separation power.

The interface device 424 provides an effective interface between the FAIMS device 490 and the spectrometer. Particularly when the spectrometer includes a mass analyzer, the resulting FAIMS-MS instrument may provide useful, highly sensitive orthogonal separation techniques.

Figure 5:
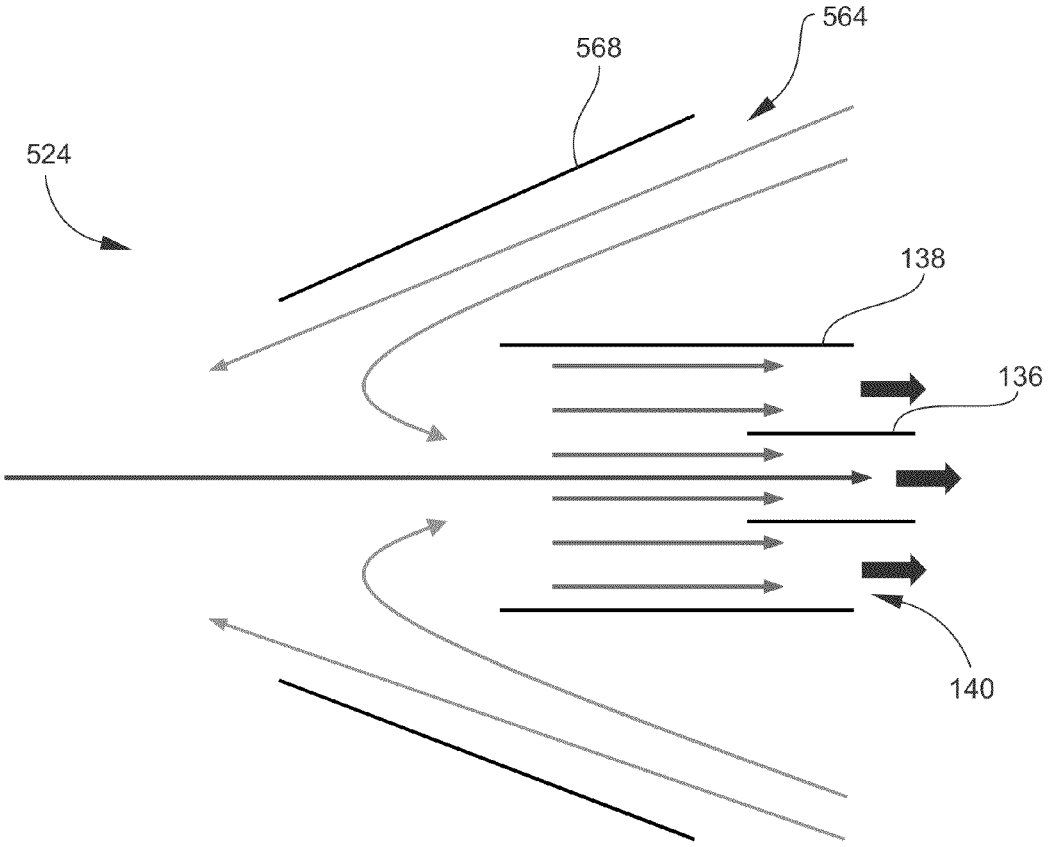
FIG. 5 is a schematic view of an example of an interface device according to another embodiment.

FIG. 5 is a schematic view of an example of an interface device 524 according to another embodiment. The interface device 524 includes a drying gas inlet 564 configured direct a flow of drying gas into the ionization chamber, specifically to the ionization region in front of the interface device 524. As described above, the drying gas is useful for completing desolvation of ions and preventing droplets from entering the inner conduit 136. The drying gas preferentially flows into the gas discharge passage 140 along with other gas species from the ionization chamber. The drying gas inlet 564 may be configured in various ways. In the illustrated embodiment, the drying gas inlet 564 includes a drying gas inlet structure 568 surrounding the outer conduit 138 such that an annular drying gas inlet passage is formed therebetween. As illustrated, the drying gas inlet structure 568 may be configured to direct the drying gas at an angle to the ion sampling axis, thereby establishing a field of gas velocities that aids in focusing ions toward the ion sampling axis. In other embodiments, the drying gas may be directed in a more parallel orientation relative to the ion sampling axis. In still other embodiments, instead of a counter-flow arrangement the drying gas may be directed in a more cross-flow arrangement such as a curtain as described above.

Figure 6:
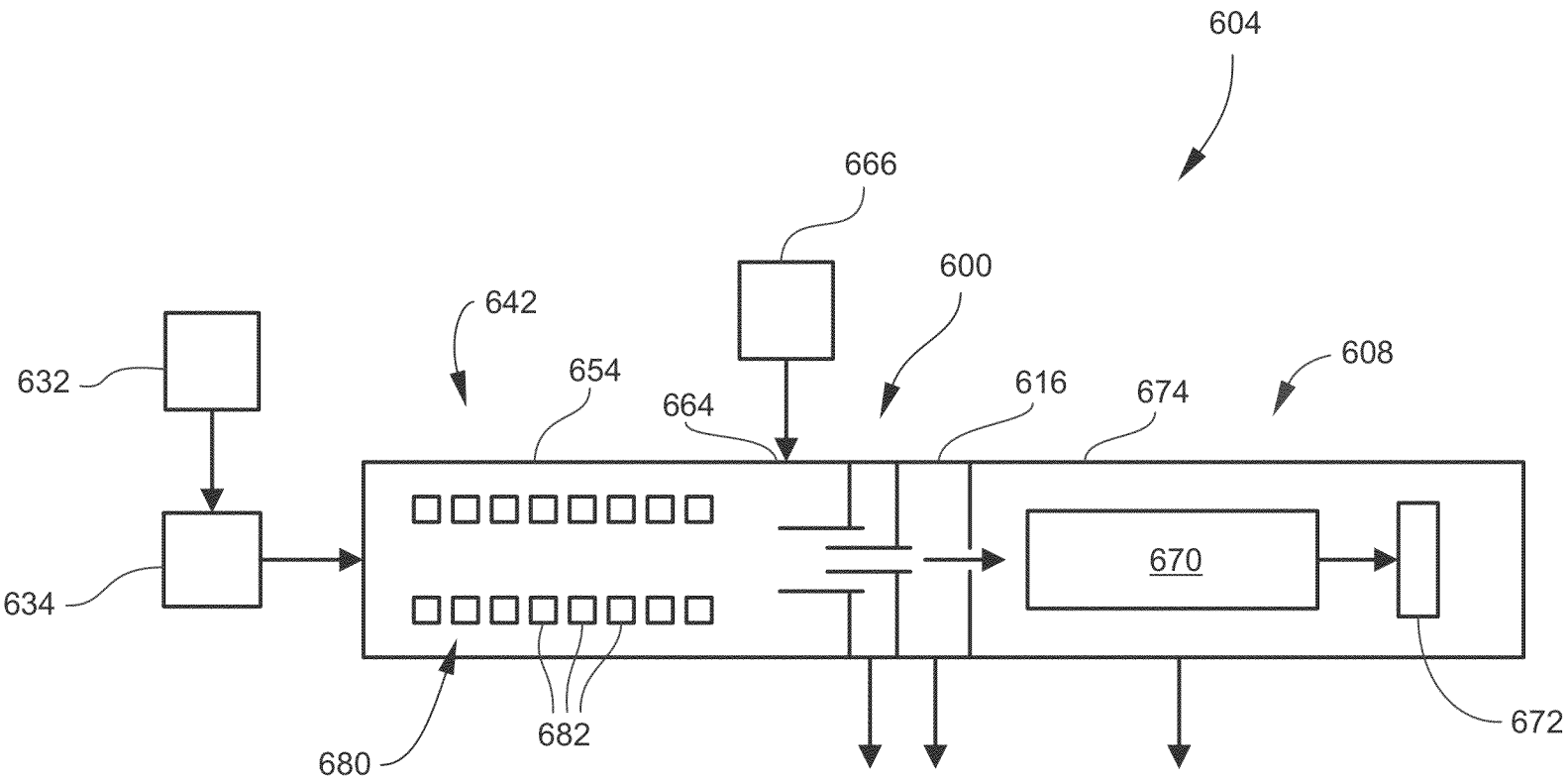
FIG. 6 is a schematic view of an example of an analytical separation system according to another embodiment.

FIG. 6 is a schematic view of an example of an analytical separation system 604 according to another embodiment. The analytical separation system 604 includes a sample source 632, an AP ionization apparatus (ion source) 634, an AP ion mobility spectrometer (AP-IMS) 642, an AP interface 600, and a mass spectrometer (MS) 608 including a mass analyzer 670 and an ion detector 672. Non-limiting examples of the sample source 634, AP ionization apparatus 634, and MS 608 are described above in conjunction with FIG. 1. The MS 608 includes a first pressure-reducing region 616 and a second pressure-reducing region 674, and may further include one or more intermediate pressure-reducing regions as also described above in conjunction with FIG. 1. The AP-IMS 642 includes a housing 654, an ion entrance into the housing 654 that receives ions produced by the ionization apparatus 634, a drift cell 680 enclosed in the housing 654, and an ion exit that transfers ions into the MS 608. The ion entrance may include ion optics, such as a gate, for introducing packets of ions into the drift cell 680. The drift cell 680 typically includes a plurality of ring-shaped lens elements 682 positioned in series along the axis of the AP-IMS 642. The drift cell 680 generates an axial DC voltage gradient along its length to move ions through the drift cell 680 against a drift gas supplied from a drift gas inlet 664 and associated drift gas source 666, whereby the ions become separated in time based on their different cross-sections as appreciated by persons skilled in the art. The DC voltage gradient may be generated in a known manner, such as by applying a voltage through a resistive divider network such that successively lower voltages are applied to successive lens elements 682 along the length of the drift cell 680.

The AP interface 600 is configured for efficiently transporting ions from a region at (or above) atmospheric pressure to a region at sub-atmospheric pressure. The AP interface 600 may also be configured for removing gas from the atmospheric-pressure region in a manner that improves the efficiency of ion transport to the sub-atmospheric region and facilitates the separation of gas from ions in the sub-atmospheric region. In the illustrated embodiment in which the analytical separation system 604 is an APIMS-MS system, the AP interface 600 is (or is located at) the ion exit of the AP-IMS 642. Hence, the region at (or above) atmospheric pressure is the interior of the AP-IMS 642 and the region at sub-atmospheric pressure is the first reduced-pressure chamber 616 of the MS 608. The AP interface 600 may be configured according to any of the embodiments disclosed herein.

In some embodiments, the analytical separation system 604 includes an additional ion detector (not shown) dedicated for measuring ions outputted from the drift cell 680. In such embodiments, some of the ions arrive at the additional ion detector and thus are not transferred into the MS 608. The additional ion detector may be positioned upstream of, at, or downstream of the AP interface 600.

Exemplary Embodiments

Exemplary embodiments provided in accordance with the presently disclosed subject matter include, but are not limited to, the following:

1. An atmospheric pressure (AP) interface for a spectrometer, the AP interface comprising: an ionization chamber comprising a wall for separating the ionization chamber from a reduced-pressure region of the spectrometer; and an interface device comprising an ion inlet and a gas passage, wherein: the ion inlet defines an ion path from the ionization chamber to the reduced-pressure region; the gas passage defines a gas path from the ionization chamber to a gas outlet external to the reduced-pressure region; the gas passage has a greater gas conductance than the ion inlet such that most gas flowing into the interface device flows into the gas passage and not the ion inlet; and the interface device is configured for applying a static electric field effective for focusing ions in the ionization chamber preferentially into the ion inlet.

2. The AP interface of embodiment 1, wherein ion inlet comprises an electrically conductive inner conduit extending along an axis through the wall from the ionization chamber to the reduced-pressure region, and the interface device further comprises an electrically conductive outer conduit extending through the wall and surrounding the inner conduit to define the gas passage therebetween, wherein the passage is outside the reduced-pressure region and terminates at a gas outlet.

3. The AP interface of embodiment 2, comprising a voltage source communicating with the inner conduit and the outer conduit and configured for generating the static electric field, wherein the static electric field has a spatial orientation that attracts ions toward the axis.

4. The AP interface of embodiment 2 or 3, wherein the outer conduit extends into the ionization chamber from the wall at a greater distance than the inner conduit.

5. The AP interface of any of embodiments 2 to 4, wherein the outer conduit has a diameter about 2 to 10 times greater than a diameter of the inner conduit.

6. The AP interface of any of embodiments 1 to 5, comprising a pump communicating with the gas passage.

7. The AP interface of embodiment 6, comprising an exhaust port communicating with the ionization chamber, wherein the pump communicates with the exhaust port.

8. The AP interface of embodiment 6 or 7, wherein the gas passage and the pump are configured for maintaining laminar or close to laminar flow through the gas passage.

9. The AP interface of any of embodiments 1 to 8, comprising a conductance limiting device communicating with the ion path.

10. The AP interface of any of embodiments 1 to 9, comprising a conductance limiting device communicating with the gas path.

11. The AP interface of any of embodiments 1 to 10, wherein the ion inlet comprises a field-asymmetric ion mobility spectrometer (FAIMS) cell.

12. The AP interface of any of embodiments 1 to 11, comprising a drying gas inlet positioned to direct a flow of drying gas into the ionization chamber in front of the outer conduit.

13. The AP interface of embodiment 12, wherein the drying gas inlet is positioned to direct the flow of drying gas toward the axis at an angle thereto.

14. An analytical separation system, comprising: the AP interface of embodiment 1; and the spectrometer, wherein the spectrometer comprises the reduced-pressure region and an analytical separation instrument in or communicating with the reduced-pressure region.

15. The analytical separation system of embodiment 14, comprising a chromatograph communicating with the ionization chamber.

16. The analytical separation system of embodiment 14 or 15, wherein the ion inlet comprises a field-asymmetric ion mobility spectrometer (FAIMS) cell.

17. The analytical separation system of embodiment 14 or 15, wherein the analytical separation instrument comprises an ion mobility spectrometer (IMS) drift cell, a mass analyzer, or an IMS drift cell followed by a mass analyzer.

18. An analytical separation system, comprising: an atmospheric pressure ion source; and an atmospheric pressure ion mobility spectrometer (IMS) drift cell comprising a cell inlet communicating with the ion source and an atmospheric pressure (AP) interface downstream from the cell inlet, the AP interface comprising an ion inlet defining an ion path from the drift cell to a reduced-pressure region, and gas passage defining a gas path from the drift cell to a location external to the reduced-pressure region.

19. The analytical separation system of embodiment 18, wherein the AP interface is configured for applying a static electric field effective for focusing ions in the drift cell preferentially into the ion inlet.

20. A method for transferring ions to a spectrometer, the method comprising: operating an ionization chamber containing ions and gas at about atmospheric pressure or greater, the ionization chamber communicating with reduced-pressure region of the spectrometer via an ion inlet; directing at least some of the gas in the ionization chamber through a passage to a gas outlet outside the reduced-pressure region, wherein the gas flows according to a pressure differential between the ionization chamber and the gas outlet; and directing the ions through the ion inlet and into the reduced-pressure region, wherein the gas flows preferentially into the passage and the ions flow preferentially into the inner conduit.

21. The method of embodiment 20, wherein the ion inlet comprises an inner conduit and the passage is formed between the inner conduit and an outer conduit surrounding the inner conduit, and directing the ions comprises applying a voltage between the inner conduit and the outer conduit to generate a static electric field in the ionization chamber in front of the inner conduit such that the ions are attracted to the inner conduit.

22. The method of embodiment 20 or 21, comprising operating the reduced-pressure region at a pressure of about 30 Torr or less.

23. The method of any of embodiments 20 to 22, comprising flowing the gas through the passage under a laminar or close to laminar flow regime.

24. The method of any of embodiments 20 to 23, comprising flowing 3 or greater times more gas into the passage than into the ion inlet.

25. The method of any of embodiments 20 to 24, comprising setting the pressure differential between the ionization chamber and the gas outlet by operating a pump downstream of the gas outlet, or by pressurizing the ionization chamber to a level above atmospheric pressure.

26. The method of any of embodiments 20 to 25, comprising adjusting a ratio of gas entering the passage to gas entering the ion inlet.

27. The method of any of embodiments 20 to 26, comprising generating an electric field inside the ion inlet transverse to a central axis of the ion inlet, wherein the electric field comprises an asymmetric waveform effective for separating the ions in the ion inlet based on field-dependent mobility.

28. The method of any of embodiments 20 to 27, comprising directing a flow of drying gas into the ionization chamber in front of the passage.

29. The method of embodiment 28, wherein the ion inlet is positioned about an axis, and directing the flow of drying gas toward the axis at an angle thereto.

It will be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An atmospheric pressure (AP) interface for a spectrometer, the AP interface comprising:

an ionization chamber comprising a wall for separating the ionization chamber from a reduced-pressure region of the spectrometer; and an interface device comprising an ion inlet and a gas passage, wherein:

the ion inlet defines an ion path from the ionization chamber to the reduced-pressure region;

the gas passage defines a gas path from the ionization chamber to a gas outlet external to the reduced-pressure region;

the gas passage has a greater gas conductance than the ion inlet such that most gas flowing into the interface device flows into the gas passage and not the ion inlet; and the interface device is configured for applying a static electric field effective for focusing ions in the ionization chamber preferentially into the ion inlet.

2. The AP interface of claim 1, wherein the ion inlet comprises an electrically conductive inner conduit extending along an axis through the wall from the ionization chamber to the reduced-pressure region, and the interface device further comprises an electrically conductive outer conduit extending through the wall and surrounding the inner conduit to define the gas passage therebetween, wherein the passage is outside the reduced-pressure region and terminates at a gas outlet.

3. The AP interface of claim 2, comprising a voltage source communicating with the inner conduit and the outer conduit and configured for generating the static electric field, wherein the static electric field has a spatial orientation that attracts ions toward the axis.

4. The AP interface of claim 2, wherein the outer conduit extends into the ionization chamber from the wall at a greater distance than the inner conduit.

5. The AP interface of claim 2, wherein the outer conduit has a diameter about 2 to 10 times greater than a diameter of the inner conduit.

6. The AP interface of claim 1, comprising a pump communicating with the gas passage.

7. The AP interface of claim 6, comprising an exhaust port communicating with the ionization chamber, wherein the pump communicates with the exhaust port.

8. The AP interface of claim 6, wherein the gas passage and the pump are configured for maintaining laminar or close to laminar flow through the gas passage.

9. The AP interface of claim 1, comprising a conductance limiting device communicating with the ion path.

10. The AP interface of claim 1, comprising a conductance limiting device communicating with the gas path.

11. The AP interface of claim 1, wherein the ion inlet comprises a field-asymmetric ion mobility spectrometer (FAIMS) cell.

12. An analytical separation system, comprising:

the AP interface of claim 1; and the spectrometer, wherein the spectrometer comprises the reduced-pressure region and an analytical separation instrument in or communicating with the reduced-pressure region.

13. The analytical separation system of claim 12, comprising a chromatograph communicating with the ionization chamber.

14. The analytical separation system of claim 12, wherein the ion inlet comprises a field-asymmetric ion mobility spectrometer (FAIMS) cell.

15. The analytical separation system of claim 12, wherein the analytical separation instrument comprises an ion mobility spectrometer (IMS) drift cell, a mass analyzer, or an IMS drift cell followed by a mass analyzer.

16. An analytical separation system, comprising:

an atmospheric pressure ion source; and an atmospheric pressure ion mobility spectrometer (IMS) drift cell comprising a cell inlet communicating with the ion source and an atmospheric pressure (AP) interface downstream from the cell inlet, the AP interface comprising an ion inlet defining an ion path from the drift cell to a reduced-pressure region, and gas passage defining a gas path from the drift cell to a location external to the reduced-pressure region.

17. A method for transferring ions to a spectrometer, the method comprising:

operating an ionization chamber containing ions and gas at about atmospheric pressure or greater, the ionization chamber communicating with reduced-pressure region of the spectrometer via an ion inlet;

directing at least some of the gas in the ionization chamber through a passage to a gas outlet outside the reduced-pressure region, wherein the gas flows according to a pressure differential between the ionization chamber and the gas outlet; and directing the ions through the ion inlet and into the reduced-pressure region, wherein the gas flows preferentially into the passage and the ions flow preferentially into the inner conduit.

18. The method of claim 17, wherein the ion inlet comprises an inner conduit and the passage is formed between the inner conduit and an outer conduit surrounding the inner conduit, and directing the ions comprises applying a voltage between the inner conduit and the outer conduit to generate a static electric field in the ionization chamber in front of the inner conduit such that the ions are attracted to the inner conduit.

19. The method of claim 17, comprising setting the pressure differential between the ionization chamber and the gas outlet by operating a pump downstream of the gas outlet, or by pressurizing the ionization chamber to a level above atmospheric pressure.

20. The method of claim 17, comprising a step selected from the group consisting of:

operating the reduced-pressure region at a pressure of about 30 Torr or less;

flowing the gas through the passage under a laminar or close to laminar flow regime;

flowing 3 or greater times more gas into the passage than into the ion inlet;

adjusting a ratio of gas entering the passage to gas entering the ion inlet;

generating an electric field inside the ion inlet transverse to a central axis of the ion inlet, wherein the electric field comprises an asymmetric waveform effective for separating the ions in the ion inlet based on field-dependent mobility;

directing a flow of drying gas into the ionization chamber in front of the passage;

directing a flow of drying gas into the ionization chamber in front of the passage at an angle to an axis of the ion inlet; and a combination of two or more of the foregoing.

* * * * *

UNITED STATES PATENT AND TRADEMARK OFFICE

CERTIFICATE OF CORRECTION

PATENT NO. : 8,952,326 B1
APPLICATION NO. : 14/071457
DATED : February 10, 2015
INVENTOR(S) : Michael Ugarov It is certified that error appears in the above-identified patent and that said Letters Patent is hereby corrected as shown below:

Title page item (56), in column 2, under "Other Publications", line 1, delete "Assymetric" and insert -- Asymmetric --, therefor.

Signed and Sealed this
Sixteenth Day of June, 2015

Michelle K. Lee

Michelle K. Lee
*Director of the United States Patent and Trademark Office*